US008375508B2

(12) United States Patent
Conrad

(10) Patent No.: US 8,375,508 B2
(45) Date of Patent: Feb. 19, 2013

(54) TORQUE BALANCER FOR A SURFACE CLEANING HEAD

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 342 days.

(21) Appl. No.: 12/722,805

(22) Filed: Mar. 12, 2010

(65) Prior Publication Data

US 2011/0219580 A1 Sep. 15, 2011

(51) Int. Cl.
*A47L 5/14* (2006.01)

(52) U.S. Cl. ..... 15/345; 15/327.6; 15/351; 15/352; 55/428

(58) Field of Classification Search ..... 15/411, 15/327.6, 15, 347, 351, 352, 345, 353, 337, 15/339; 55/337, 482, DIG. 3, 426, 345, 428
See application file for complete search history.

(56) References Cited

U.S. PATENT DOCUMENTS

| | | | | |
|---|---|---|---|---|
| 2,542,634 | A * | 2/1951 | Davis et al. | 55/426 |
| 4,853,008 | A * | 8/1989 | Dyson | 55/345 |
| 5,078,761 | A | 1/1992 | Dyson et al. | |
| 6,026,540 | A * | 2/2000 | Wright et al. | 15/347 |
| 6,173,474 | B1 | 1/2001 | Conrad | |
| 6,260,234 | B1 * | 7/2001 | Wright et al. | 15/353 |
| 6,334,234 | B1 * | 1/2002 | Conrad et al. | 15/347 |
| 6,353,963 | B1 * | 3/2002 | Bair et al. | 15/351 |
| 6,910,245 | B2 * | 6/2005 | Hawkins et al. | 15/339 |
| 7,146,681 | B2 * | 12/2006 | Wright et al. | 15/353 |
| 7,410,516 | B2 * | 8/2008 | Ivarsson et al. | 55/337 |
| 7,776,120 | B2 * | 8/2010 | Conrad | 55/426 |
| 7,803,207 | B2 * | 9/2010 | Conrad | 55/426 |
| 8,015,659 | B2 * | 9/2011 | Conrad et al. | 15/347 |
| 2009/0165431 | A1 * | 7/2009 | Oh | 55/337 |
| 2009/0217635 | A1 * | 9/2009 | Bertram et al. | 55/428 |

FOREIGN PATENT DOCUMENTS

| | | |
|---|---|---|
| WO | 2009/026709 | 5/2009 |

* cited by examiner

*Primary Examiner* — Joshua J Michener
*Assistant Examiner* — Chi Q Nguyen
(74) *Attorney, Agent, or Firm* — Philip C. Mendes da Costa; Bereskin & Parr LLP S.E.N.C.R.L. s.r.l.

(57) ABSTRACT

An upright surface cleaning apparatus has a front end, a rear end and opposed lateral sides and a surface cleaning head having a dirt inlet and rear wheels. The rear wheels have an axis of rotation and a radius. The surface cleaning apparatus also includes an upper section and an upper section mount. The upper section mount movably mounts the upper section to the surface cleaning head at a position forward of the axis of rotation of the rear wheels. The surface cleaning head is movable between an floor cleaning position and a storage position. The surface cleaning apparatus includes an air flow path extending from the dirt inlet to a clean air outlet with a suction motor and a treatment member provided in the air flow path. The air flow path comprises a hose extending between the surface cleaning head and the upper section.

26 Claims, 16 Drawing Sheets

TORQUE BALANCER FOR A SURFACE CLEANING HEAD

FIELD

The disclosure relates to surface cleaning apparatuses, such as vacuum cleaners. Particularly, the disclosure relates to a torque balancer connecting a surface cleaning head to an upright portion of the surface cleaning apparatus.

INTRODUCTION

The following is not an admission that anything discussed below is prior art or part of the common general knowledge of persons skilled in the art.

Various constructions for surface cleaning apparatus such as vacuum cleaners are known. Currently, many surface cleaning apparatus are constructed using at least one cyclonic cleaning stage. The air is drawn into the vacuum cleaner through a dirty air inlet and conveyed to a cyclone inlet. The rotation of the air in the cyclone results in some of the particulate matter in the airflow stream being disentrained from the airflow stream. This material is then collected in a dirt collection chamber, which may be at the bottom of the cyclone or in a dirt collection chamber exterior to the cyclone chamber (see for example WO2009/026709 and U.S. Pat. No. 5,078,761). One or more additional cyclonic cleaning stages and/or filters may be positioned downstream from the cyclone.

SUMMARY

The following summary is provided to introduce the reader to the more detailed discussion to follow. The summary is not intended to limit or define the claims.

An upright surface cleaning apparatus has an upper section, that may house one or more operating components, such as an air treatment member (e.g., a cyclone) and/or a suction motor. An advantage to placing these components of the upper section is that a floor cleaning head may have a reduced height thereby enhancing the ability of the cleaning head to clean under furniture. One factor that assists in obtaining good cleanability of, e.g., carpet, is to position a dirty air inlet and/or a cleaning brush associated with the dirty air inlet at the correct position with respect to the floor that is to be cleaner. As the floor cleaning head is moved forwardly or rearwardly, the front end of the floor cleaning head may be lifted off the floor or pressed down to the floor (e.g., pressed into carpet). Therefore, the cleanability of the unit may vary during use of the unit. This movement may be enhanced as weight is removed from the cleaning head by the placement of operating components on the upper section.

In order to assist in maintaining the front end at a desired position with respect to the floor, the upper section is movably mounted, and preferably, pivotally mounted, to the floor cleaning head at a position somewhat forward of the rear wheels. Therefore, when a user moves the surface cleaning apparatus by using a handle forming part of an upper section, a downward force is applied in front of the rear wheels. This downward force counteracts a tendency the front end of the floor cleaning head may have to move upwardly during use. The exact location of the mounting position of the upper section will vary depending upon several factors such as the weight of the floor cleaning head, the configuration of the floor cleaning head and the like. Preferably, the mounting position of the upper section is proximate to the axle of the rear wheels (e.g., within the perimeter of the rear wheel or within 1-2 inches of the axle of the rear wheels).

According to a first aspect, an upright surface cleaning apparatus has a front end, a rear end and opposed lateral sides and a surface cleaning head having a dirt inlet and rear wheels. The rear wheels have an axis of rotation and a radius. The surface cleaning apparatus also includes an upper section and an upper section mount. The upper section mount movably mounts the upper section to the surface cleaning head at a position forward of the axis of rotation of the rear wheels. The surface cleaning head is movable between an floor cleaning position and a storage position. The surface cleaning apparatus includes an air flow path extending from the dirt inlet to a clean air outlet with a suction motor and a treatment member provided in the air flow path. The air flow path comprises a hose extending between the surface cleaning head and the upper section.

In some examples the rear wheels are positioned below the upper section when the upper section extends vertically upwardly from the surface cleaning head.

In some examples, the upper section is pivotally mounted to the surface cleaning head at a position that is 1-2 inches forward of the axis of rotation of the rear wheels.

In some examples, the upper section is pivotally mounted to the surface cleaning head at a position within the radius of the rear wheels.

In some examples, the rear wheels have a diameter of 1.5-4 inches.

In some examples, the rear wheels have a diameter of 2-3 inches.

In some examples, the upper section is rotatably mounted with respect to the floor cleaning head about a longitudinal axis extending through a lower portion of the upper section.

In some examples, the upper section comprises an upflow conduit on which the treatment member is provided.

In some examples, the upper section comprises a removable cleaning unit and the treatment member and the suction motor are provided in the removable cleaning unit.

In some examples, the upper section comprises an upflow conduit on which the treatment member is provided.

In some examples, the surface cleaning head further comprises a brush motor. An electrical conductive member electrically connects the brush motor to the upper section. The electrical conductive member comprises a wire extending from upper section to the floor cleaning head and at least a portion of the wire is positioned external to the upper section and the floor cleaning head.

In some examples, the upper section mount comprises a fork section wherein each fork is pivotally mounted to the surface cleaning head at laterally spaced apart locations.

In some examples, the hose is positioned between the forks.

In accordance with another aspect, an upright surface cleaning apparatus has a front end, a rear end and opposed lateral sides. The surface cleaning apparatus also comprises a surface cleaning head having a dirt inlet and rear wheels. The rear wheels have an axis of rotation and a radius. The surface cleaning apparatus also includes an upper section and an upper section mount. The upper section mount movably mounts the upper section to the surface cleaning head at a position forward of the axis of rotation of the rear wheels and within the radius of the rear wheels. The surface cleaning head is movable between a floor cleaning position and a storage position. The surface cleaning apparatus includes an airflow path extending from the dirt inlet to a clean air outlet and a suction motor and a treatment member provided in the airflow path.

In some examples, the rear wheels are positioned below the upper section when the upper section extends vertically upwardly from the surface cleaning head.

In some examples, the upper section is pivotally mounted to the surface cleaning head at a position that is 1-2 inches forward of the axis of rotation of the rear wheels.

In some examples, the upper section is pivotally mounted to the surface cleaning head at a position within the radius of the rear wheels.

In some examples, the rear wheels have a diameter of 1.5-4 inches.

In some examples, the rear wheels have a diameter of 2-3 inches.

In some examples, the upper section is rotatably mounted with respect to the floor cleaning head about a longitudinal axis extending through a lower portion of the upper section.

In some examples, the upper section comprises an upflow conduit on which the treatment member is provided.

In some examples, the upper section comprises a removable cleaning unit and the treatment member and the suction motor are provided in the removable cleaning unit.

The surface cleaning apparatus of claim 22 wherein the upper section comprises an upflow conduit on which the treatment member is provided.

In some examples, the surface cleaning head also includes a brush motor. An electrical conductive member electrically connects the brush motor to the upper section. The electrical conductive member is a wire extending from upper section to the floor cleaning head and at least a portion of the wire is positioned external to the upper section and the floor cleaning head.

In some examples, the upper section mount comprises a fork section wherein each fork is pivotally mounted to the surface cleaning head at laterally spaced apart locations.

In some examples, the hose is positioned between the forks.

BRIEF DESCRIPTION OF THE DRAWINGS

Reference is made in the detailed description to the accompanying drawings, in which.

DETAILED DESCRIPTION

Figure 1:
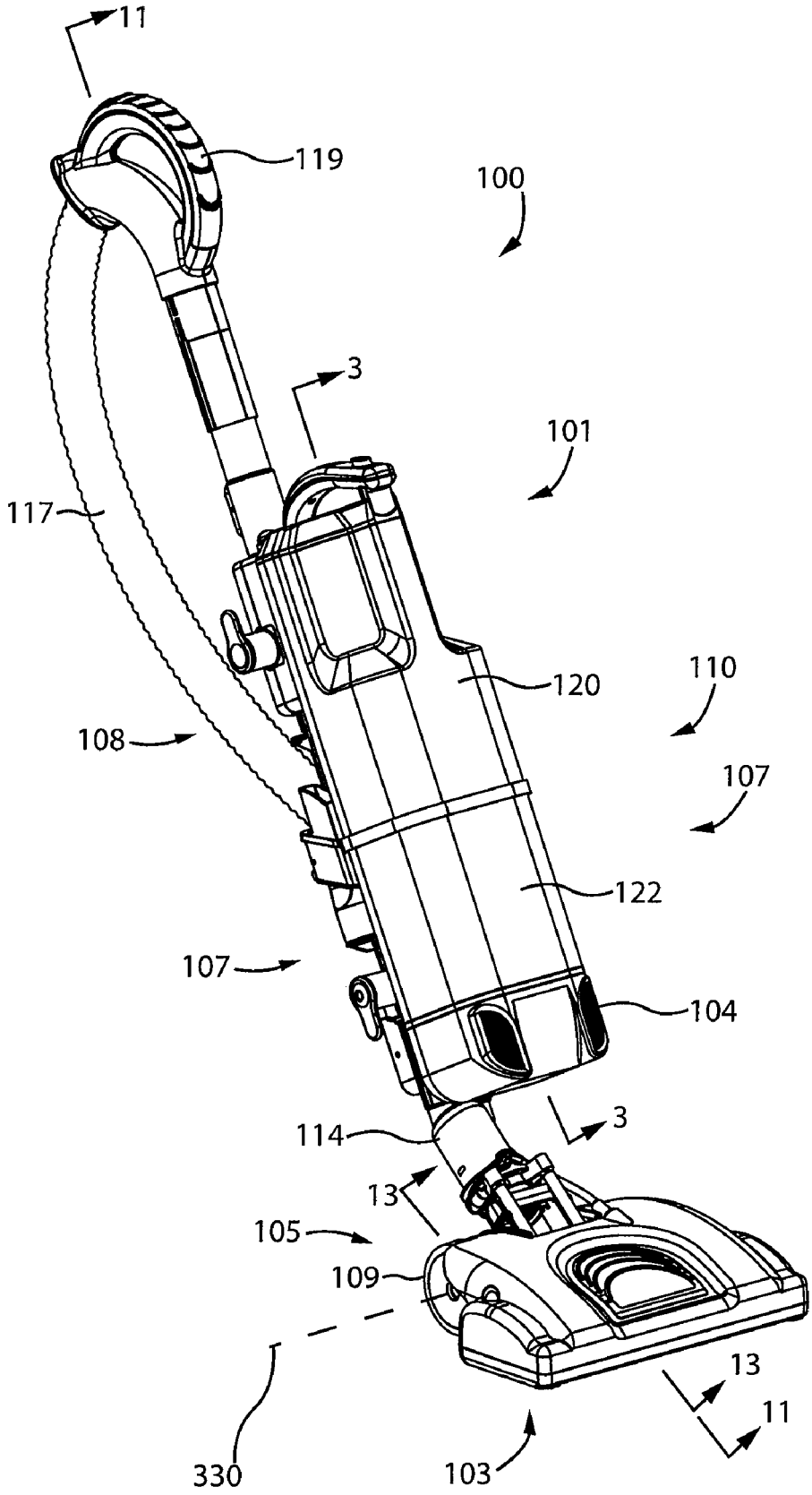
FIG. 1 is a front isometeric view of a surface cleaning apparatus.

Referring to FIG. 1, a first embodiment of a surface cleaning apparatus 100 is shown. In the embodiment shown, the surface cleaning apparatus 100 is an upright vacuum cleaner. In alternate embodiments, the surface cleaning apparatus may be another suitable type of surface cleaning apparatus, such as a canister type vacuum cleaner, and hand vacuum cleaner, a stick vac, a wet-dry type vacuum cleaner or a carpet extractor.

Figure 9:
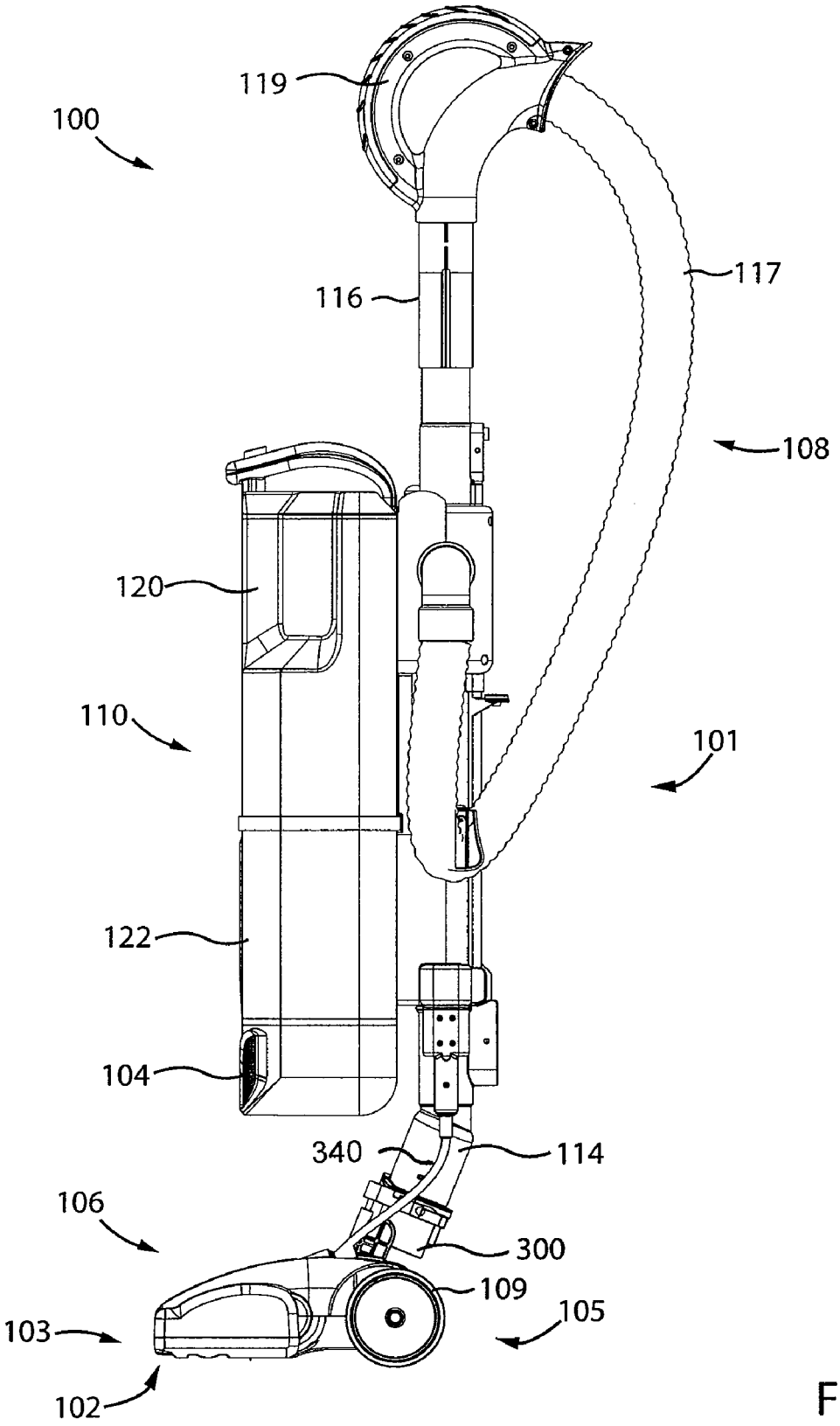
FIG. 9 is side view of the surface cleaning apparatus of FIG. 1 in a first position.
Figure 10:
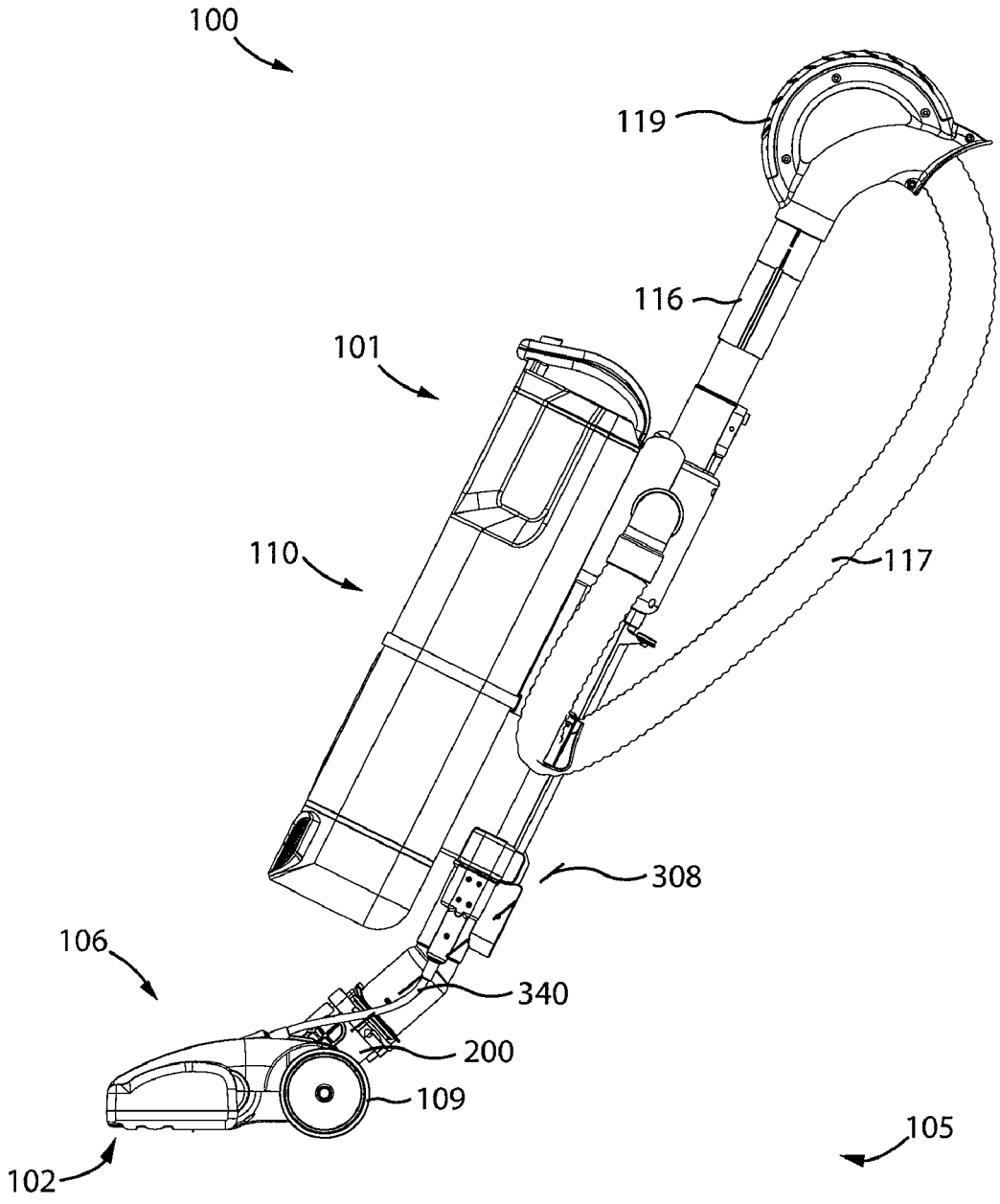
FIG. 10 is a side view of the surface cleaning apparatus of FIG. 9 in a second position.
Figure 11:
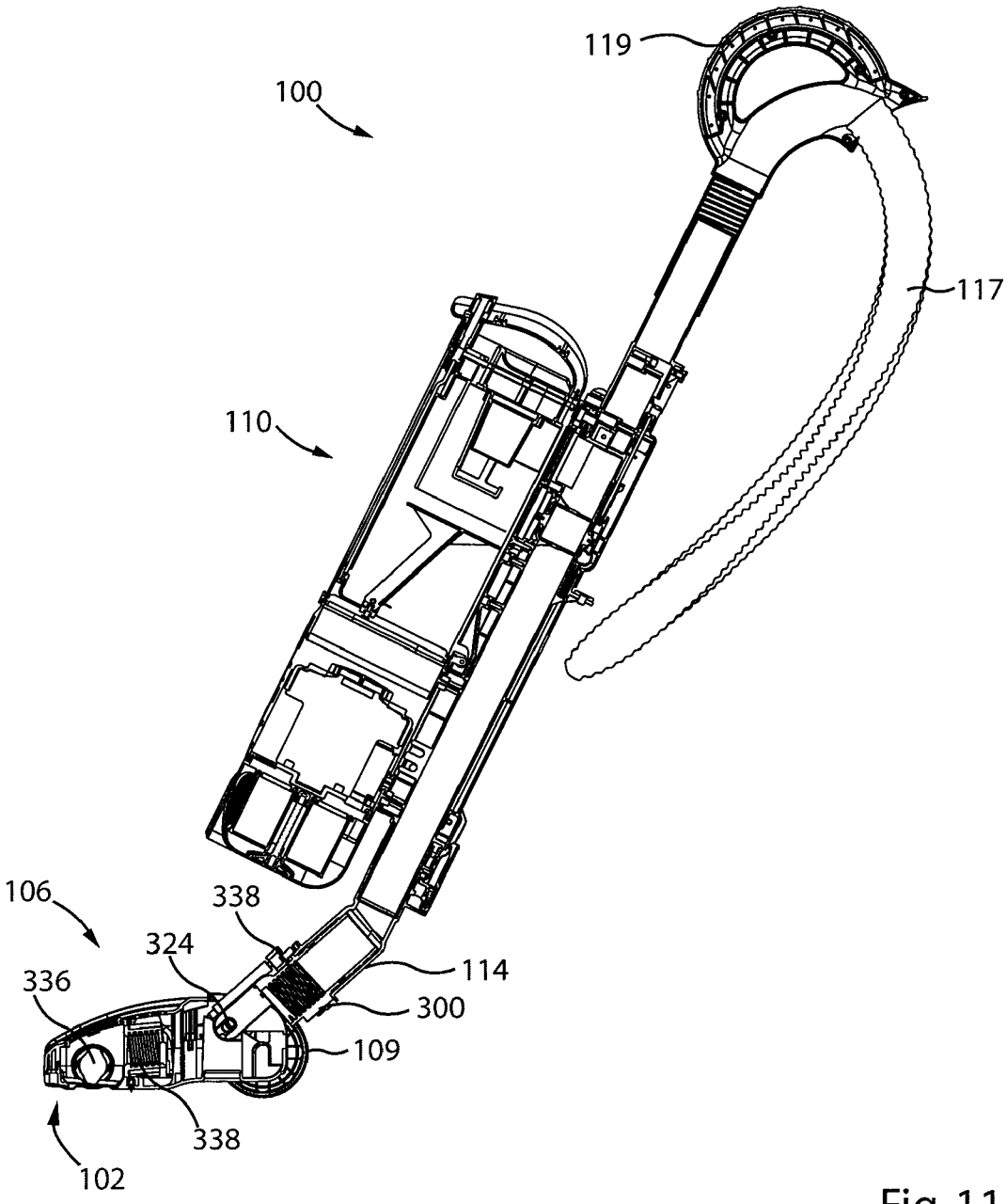
FIG. 11 is a section view of taken along line 11-11 in FIG. 1.

Referring still to FIG. 1, the surface cleaning apparatus 100 has an upper section, for example support structure 101, that is movably and drivingly connected to a surface cleaning head 106. The surface cleaning apparatus 100 has a front end 103, a rear or back end 105 and a pair generally opposed lateral sides 107. The support structure 101 is movable between a first position, for example a storage position as exemplified in FIG. 9, and a second position, for example a use or floor cleaning position as exemplified in FIGS. 1, 10 and 11. In either position, the support structure 101 is understood to be extending generally vertically, upwardly above the surface cleaning head 106. The surface cleaning head 106 supports the weight of the upper section of the surface cleaning apparatus 100, and is rollingly maneuverable over a surface to be cleaned on rear wheels 109. While shown having two rear wheels 109, it is understood that other examples of surface cleaning heads 106 can be supported using a different number of rear wheels, one or more front wheels, casters or any other suitable transportation members.

In some examples the rear wheels 109 have a diameter between 1-5 inches. In other examples, the rear wheel 109 diameter can be between 1.5-4 inches, and optionally between 2-3 inches. Rear wheel 109 diameter can be selected based on a plurality of factors including, for example, expected surface conditions, expected loads and aesthetic appearance.

The surface cleaning apparatus 100 also has a dirty air inlet 102, a clean air outlet 104, and an air flow path or passage extending therebetween. In the embodiment shown, an example of the dirty air inlet 102 is provided in a surface cleaning head 106. From the dirty air inlet 102, the airflow passage extends through the surface cleaning head 106, and through an air conduit 108, to a suction and filtration unit 110. The clean air outlet 104 is provided in the suction and filtration unit 110. Optionally, the suction and filtration unit 110 can be releasably mounted to the supporting structure of the surface cleaning apparatus 100. The releasable connection between the suction and filtration unit 110 and the supporting structure can be of any suitable type, and can optionally including locking means for securing the suction and filtration unit 110 in place.

As exemplified, the upper section, for example the support structure 101, includes the portions of the surface cleaning apparatus 100 that are supported above the surface cleaning head 106, including, for example the lower upflow duct 114, the suction and filtration unit 110 (or any other suitable cleaning unit), the upper upflow duct 116, the handle 119 and the flexible hose 117. In this example portions of the support structure 101 serve as both rigid, structural support members as well as forming a portion of the air flow path 108. In other examples, structural members may be distinct from portions of the air flow path.

Referring to FIGS. 9-15, the support structure 101 is movably connected to the surface cleaning head using an upper section mount, for example mount 300, that is pivotally connected to the surface cleaning head 106. In the embodiment shown, mount 300 includes a generally tubular conduit section 302 and fork section 304 comprising a pair of spaced apart fork members or tines 306. Optionally, the mount 300 can comprise an alignment mechanism for aligning and guiding the upper section into a predetermined position relative to the surface cleaning head, for example a rotationally centered position for storage. The mount 300 can also include a locking mechanism for retaining the upper section in a fixed angular and/or rotation position relative to the surface cleaning head 106. The alignment and locking mechanisms can be any suitable mechanisms known in the art.

The conduit section 302 is rotatably connected with the upstream end of the lower upflow duct 114, such that the lower upflow duct 114 (and the rest of the upper section) can rotate about an upper section pivot axis 320. One example of the rotational connection provided by the mount 300 includes providing at least one seal groove 308, for receiving a sealing member such as o-ring 309, and a securement groove 310, for receiving a securement member such as locking ring 311, on the downstream end of the conduit section 302.

To provide the rotatable connection between the conduit section 302 and the lower upflow duct 114, downstream end of the conduit section 302 is inserted into a the upstream end of the lower upflow duct 114. In this example, the lower upflow duct 114 is a generally tubular member having an inner diameter sized to receive the conduit member 302 and generally smooth inner surface for contacting and sealing against o-ring 309. Contact between the o-ring 309 and the inner surface of the lower upflow duct 114 provides a generally air-tight seal, while still allowing relative rotation between the lower upflow duct 114 and the conduit section 302.

To assemble the rotatable connection, the o-ring 309 can be seated within the corresponding sealing groove 308 and locking ring 311 can be seated in corresponding securement groove 310. Locking ring 311 is freely rotatable within the securement groove 310. When the conduit section 302 is inserted to a predetermined locking position, barbs 314 on the outer, peripheral surface of the locking ring 311 extend into and engage corresponding slots 316 in the lower upflow duct 114. The engagement between the barbs 314 and slots 316 prevents relative axial motion between the locking ring 311 and the lower upflow duct 114, and side walls of the securement groove 310 prevent relative axial movement between the locking ring 311 and the conduit section 302, thereby retaining the conduit section 302 within the lower upflow duct 114. Optionally the rotatable connection can be releasable connections, enabling a user to selectably attach and detach the support structure 101 from the surface cleaning head 106.

In the present example the conduit section 302 can form part of the air flow path connecting the dirty air inlet 102 with the suction and filtration unit 110. In other examples, the conduit section 302 may not form part of the air flow path.

Each tine 306 of the fork section 304 is pivotally connected to a frame portion 322 of the surface cleaning head 106 using a pivoting, pin joint 324, comprising pins 326 that are inserted into corresponding mount apertures 328. In this configuration, the mount 300 can pivot relative to the surface cleaning head 106 about a mount pivot axis 331 that extends through the mount apertures 328 and is coincident with the longitudinal axis of the pins 326, as exemplified in FIG. 15. The rear wheels 109 are also rotatably connected to the frame portion 322 of the surface cleaning head 109 using any suitable, rotatably connector, including, for example pin connections, axles and bearings. The rear wheels 109 are connected to corresponding wheel apertures 334 and have a rear wheel axis of rotation 330 extending therethrough. As exemplified, the mount apertures 328 are positioned forward of wheel apertures 334 in the surface cleaning head 106. Accordingly, the mount pivot axis 331 is positioned forward of the rear wheel axis of rotation 330 by a distance 338.

When the surface cleaning apparatus 100 is in use, a portion of the weight of the support structure 101 is supported by the surface cleaning head 106 via the pin joint 134 joining the mount 300 with the surface cleaning head 106. Another portion of the weight, referred to as the hand weight, is supported by a user who is holding and manipulating the surface cleaning apparatus 100. The distribution of the weight, between user and surface cleaning head 106, is based on the relative angular position of the support structure 101 relative to the surface cleaning head 106. When the surface cleaning apparatus 100 is in the storage position, as exemplified in FIGS. 9 and 12, substantially all of the weight of the surface cleaning apparatus 100 is supported by the surface cleaning head 106. When the is in a floor cleaning position, as exemplified in FIGS. 10 and 13, at least a portion of the weight is supported by the user.

In examples in which the surface cleaning head 106 is supported by a pair of rear wheels 109, the rear wheel rotation axis 330 can also define the axis about which the entire surface cleaning head 109 will rotate when subjected to external loads. In this configuration, loads applied to the surface cleaning head 106 behind the rear wheel rotation axis 330, i.e. behind the rear wheel apertures 334, will exert a torque or moment force about the rear wheel rotation axis 330 urging the surface cleaning head 106 to rotate about the axis 330 backward, in a counter-clockwise direction, as seen in FIGS. 9-13. Under such loading conditions, the front end of the surface cleaning head 106, comprising the dirty air inlet 102, will be urged generally upward, away from the surface being cleaned.

In some examples, the suction performance and surface cleaning effectiveness of the surface cleaning head 106 can depend on the position of the dirty air inlet 102, and any accessories contained therein (such as rotatable brush 336), relative to the surface being cleaned. In such examples, torques and other forces that urge the front end 103 of the surface cleaning apparatus 100 upwards may reduce cleaning efficiency.

Positioning the pivot mount apertures 328 in front of the rear wheel apertures 334, i.e. between the rear wheel apertures 334 and the front end 103 of the surface cleaning apparatus 100, enables torques exerted on the surface cleaning head 106 by the support structure 101 to urge the surface cleaning head 106 to pivot forward, i.e. in the clockwise direction when viewed in FIGS. 9-14. Forces urging the surface cleaning head 106 to pivot forward have the effect of urging the dirt air inlet 102 in a generally downward direction, toward the surface being cleaned.

Configuring the surface cleaning apparatus 100 in this manner, such that torque exerted by the support structure 101 urges the surface cleaning head 106 to rotate forward, can inhibit the dirty air inlet 102 from being lifted away from the surface being cleaning and may reduce the portion of the weight of the surface cleaning apparatus experienced as hand weight by the user.

In some examples, the mount pivot axis 331, defined by the mount apertures 328, is also located above (i.e. further from the surface) than the rear wheel rotation axis 330.

Figure 12:
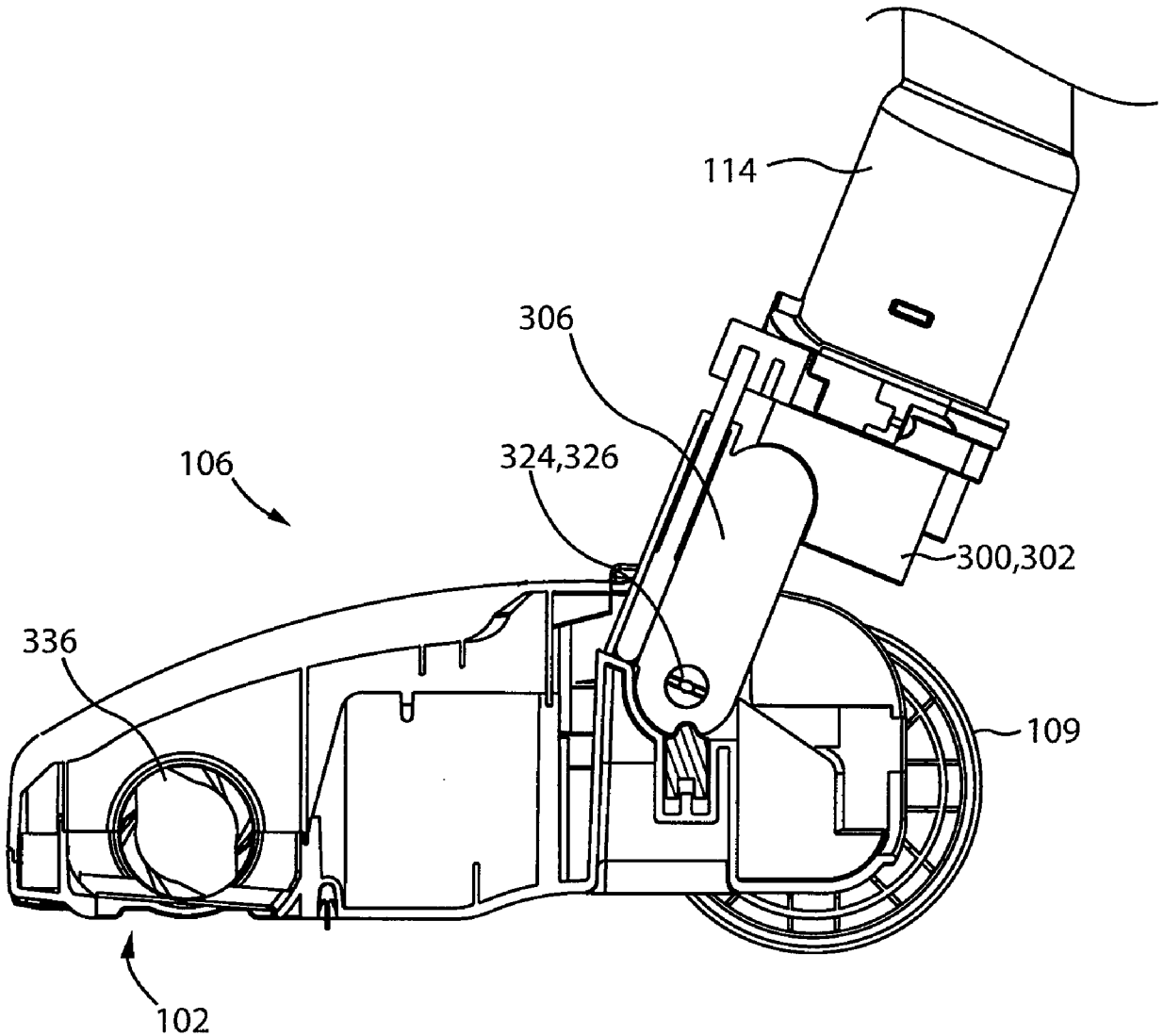
FIG. 12 is a section view of an example of the surface cleaning head of FIG. 9.
Figure 13:
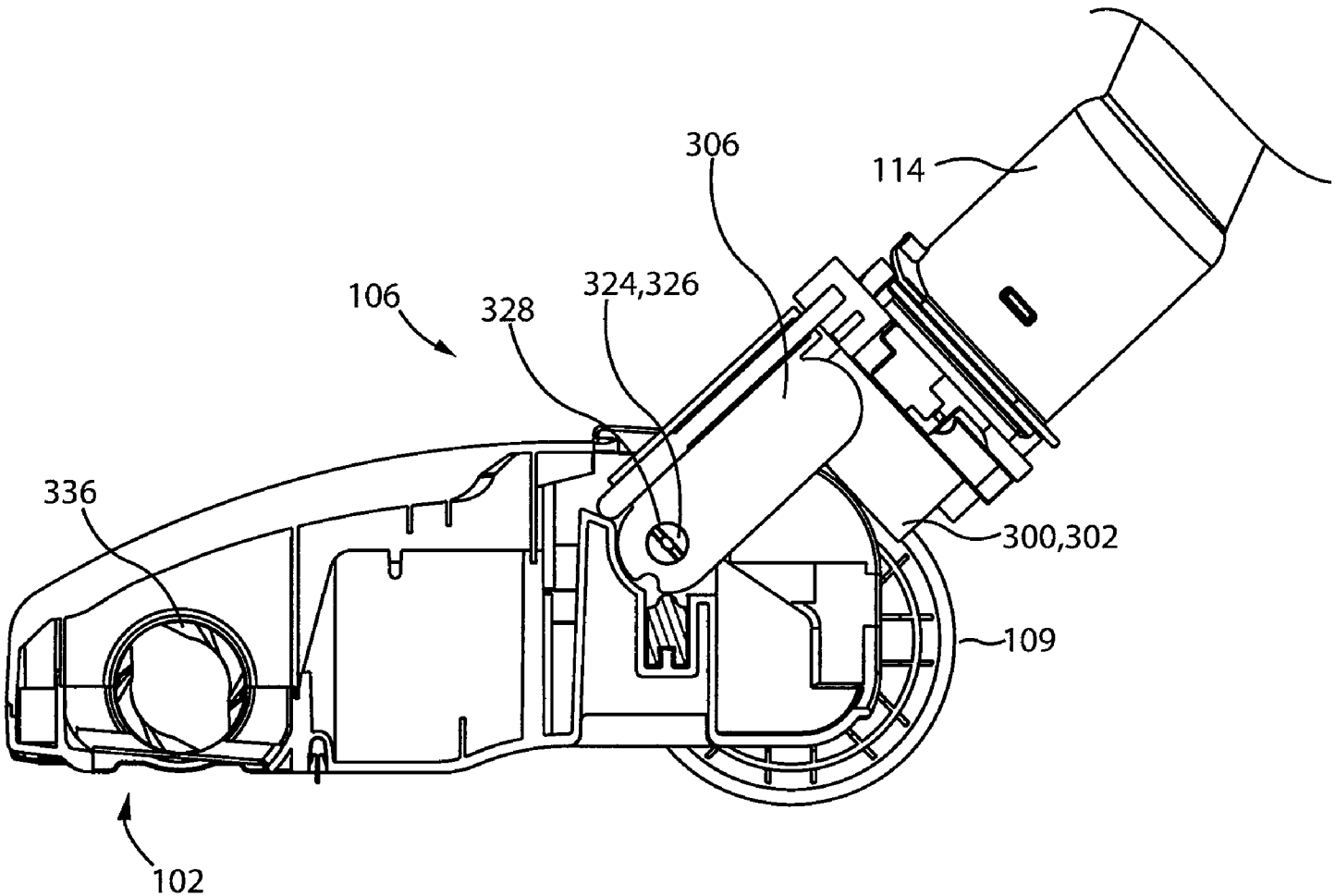
FIG. 13 is a section view taken along line 13-13 in FIG. 1.
Figure 15:
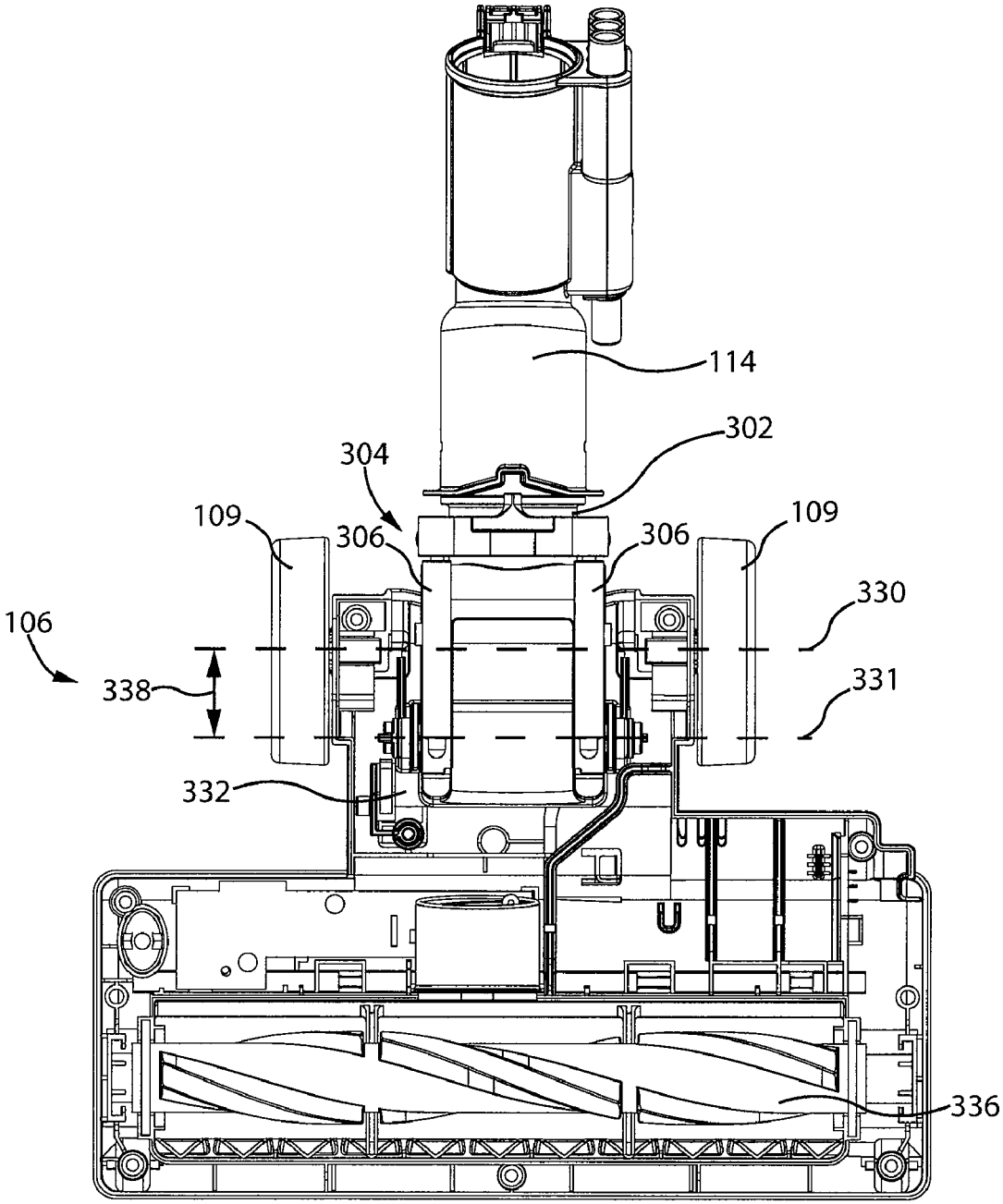
FIG. 15 is a top view of the surface cleaning head of FIG. 1.

Optionally, as exemplified in FIGS. 12, 13 and 15, the mount apertures 328 can be positioned so that the mount pivot axis 331 lies on or within the circumference of the rear wheels 109. In such examples, the mount pivot axis and the rear wheel pivot axis 330 can be separated or offset by a distance 338 that is generally less than or equal to the radius of the rear wheels 109. In other examples, the mount apertures 328 can be positioned further forward in the surface cleaning head 106, such that the mount pivot axis 331 and rear wheel rotation axis 330 are offset by a distance that is greater than the radius of the rear wheels 109. In some examples, the position of the pivot mount axis 331 can be set to any suitable, predetermined position, including between ½-4 inches and between 1-2 inches in front of the rear wheel pivot axis 330.

Figure 16:
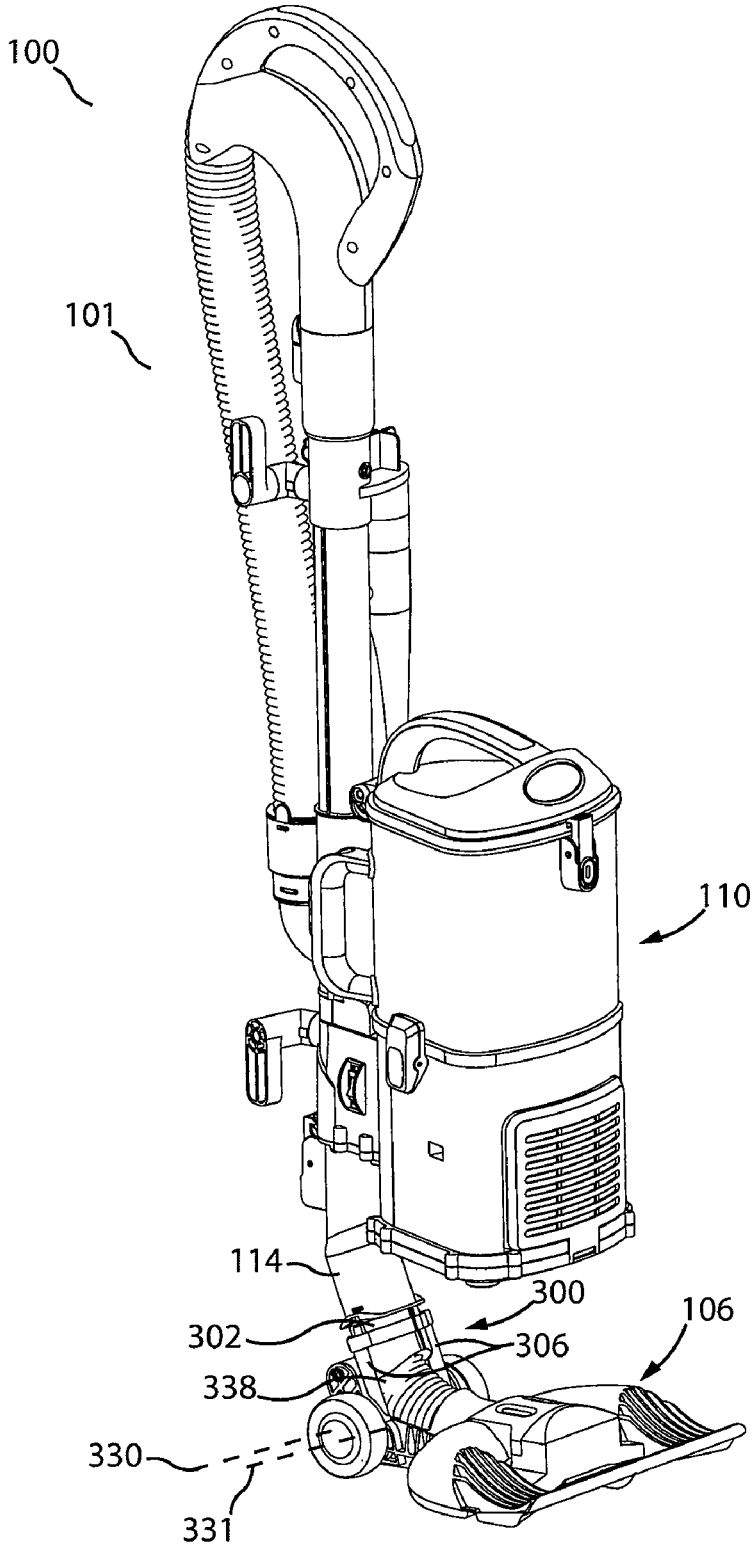
FIG. 16 is a front isometric view of another example of a surface cleaning apparatus.

Referring to FIG. 16, another example of a surface cleaning apparatus 100 includes a support structure 101 that is pivotally and rotatably connected to a surface cleaning head 106 by a mount 300. The mount 300 includes a pair of tines 306 that are pivotally connected to the surface cleaning head 106 at a position in front of the rear wheel connection (i.e. rear wheel apertures), thereby providing a mount pivot axis 331 that is in front of the rear wheel rotation axis 330.

The surface cleaning head 106 can be a non-powered cleaning head or a powered cleaning head. As exemplified in FIGS. 1 and 9-15, the surface cleaning head 106 is a powered surface cleaning head that includes an electric motor for driving rotatable brush 336. To provide electrical power to the surface cleaning head 106, the surface cleaning apparatus 100 includes an electrical conductive member, for example wire 340, that extends from the suction and filtration unit 110 (which can be plugged into a wall outlet) to the surface cleaning head 106. In the illustrated example a portion of the wire 340 is exposed, i.e. disposed outside the members of the support structure 101 and the surface cleaning head 106. In other examples the wire 340 can be contained within portions of the support structure 101 and/or the surface cleaning head 106.

In one example shown, the air conduit 108 includes a the conduit section 302 of the mount 300 connected to the surface cleaning head 106, a lower upflow duct 114, an upper upflow duct 116 and a flexible hose 117, in airflow communication with the suction and filtration unit 110. In alternate embodiments, the air conduit 108 may be of another configuration. The dirty air inlet 102 can be fluidly connected to the conduit section 302 using any suitable fluid conduit, that comprises an internal portion or chamber of the surface cleaning head 106 and a connecting conduit extending from the surface cleaning head 106 to the upstream end of the conduit section 302.

Figure 14:
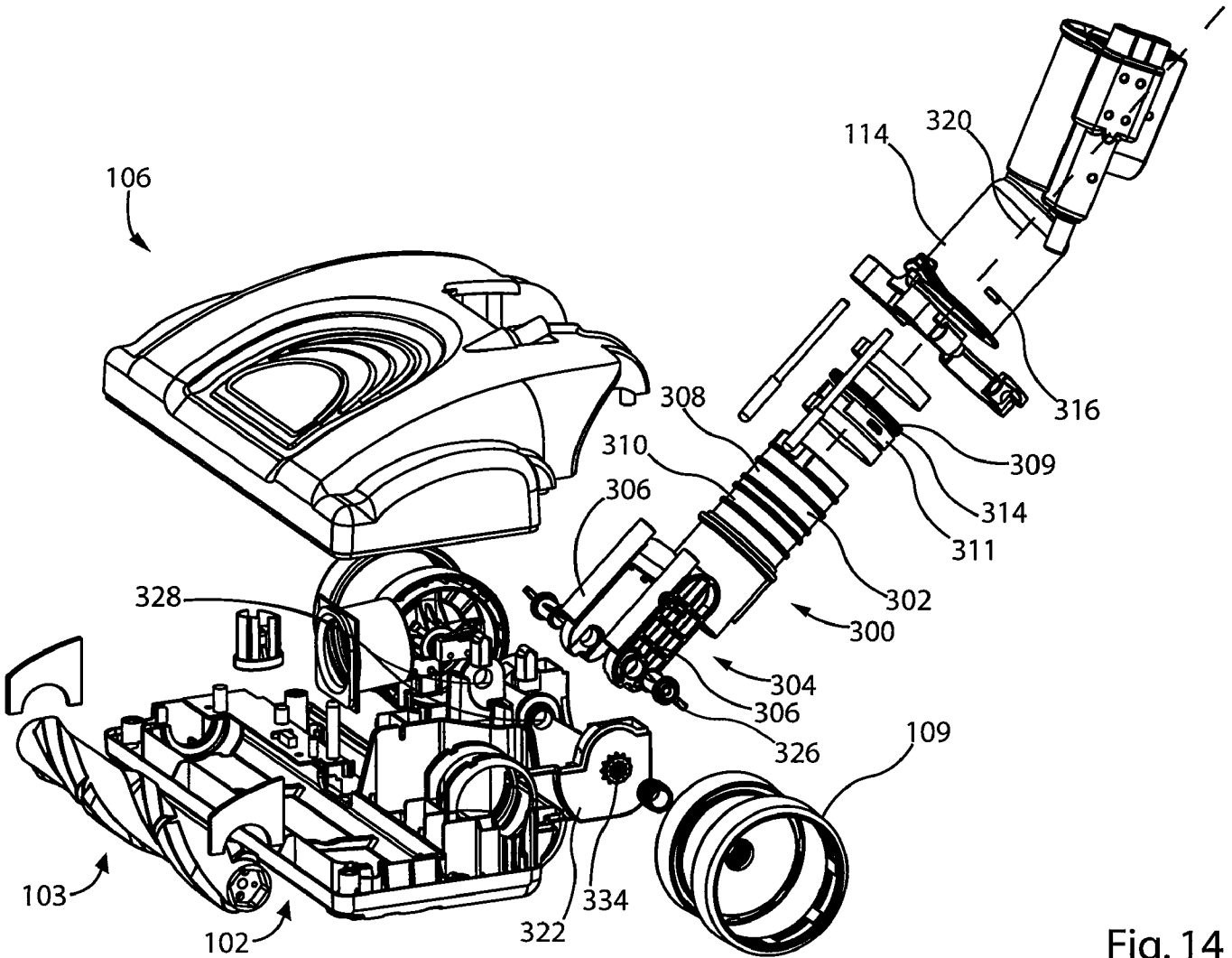
FIG. 14 is an exploded view of the surface cleaning head of FIG. 13.

In some examples, the connecting conduit can be a flexible hose 338 that extends between the surface cleaning head 106 and the conduit section 302, as exemplified in FIG. 14. As exemplified, the flexible hose 338 can pass between the tines 306 of the mount 300. In other examples, the flexible hose 338 can extend through the interior of the conduit member 302 can connect directly to the downstream end of the lower upflow duct 114. While not shown in all of the figures (for clarity) a flexible hose 338 can also be used to connect the surface cleaning head 106 to the support structure 101 in the example illustrated in FIGS. 1-15, as exemplified in FIG. 11.

A handle 119 is mounted to the upper upflow duct 116, to allow a user to manipulate the surface cleaning apparatus 100 and maneuver the surface cleaning head 106 across a surface to be cleaned, for example a floor.

The suction and filtration unit 110 includes a filtration member housing 120, and a suction motor housing 122. The filtration member housing 120 houses air treatment members or filtration members, for example a cyclone, which is positioned in the airflow passage downstream of the dirty air inlet 102 for removing particulate matter from air flowing through the airflow passage. The suction motor housing 122 houses a suction motor (not shown), which is provided in the airflow passage downstream of the cyclone for drawing air through the airflow passage.

In the embodiment shown, as the suction motor housing 122 is mounted to the lower upflow duct 114, and the filtration member housing 120 is removably mounted to the suction motor housing 122 above the suction motor housing 122, the filtration member housing 120 may optionally be secured to the suction motor housing 122 using one or more latches or locking members (not shown). In such instances the filtration member housing 120 can be detached from the suction motor housing by unlatching the one or more latch members, and lifting the filtration member housing 120 off of the suction motor housing 122. When this is done, the filtration member housing 120 will be generally sealed, except for any airflow passages leading to or from the filtration member housing 120, and the top of the suction motor housing 122 will be open. The top of the suction motor housing 122 may be covered with a suitable pre-motor filter positioned upstream of the suction motor and downstream of the cyclone. The suction motor housing 122 may also include a post-motor filter downstream of the suction motor and upstream of the clean air outlet. The post-motor filter may be any suitable type of filter, such as, for example, a HEPA filter.

In one embodiment, as exemplified in FIGS. 2-8, the filtration member housing 120 includes a sidewall 130, a top wall 132, and a bottom wall 134. In the embodiment shown, the filtration member, or cyclone, housed in the filtration member housing 120 is a cyclone 144. In alternate embodiments, the filtration member may be, for example, a filter, such as a filter bag or a foam filter. In further alternate embodiments, the filtration member may include a plurality of cyclones, or a plurality of cyclonic stages.

The cyclone 144 may be of any suitable configuration. In the embodiment shown, the cyclone 144 extends along a longitudinal axis 146, which is generally vertically extending, and includes a generally cylindrical cyclone wall 148, which defines a cyclone chamber 150. Some or all of the cyclone wall 148 can coincide with portions of the side walls 130, as exemplified, for example in FIGS. 3 and 4. Alternatively, in some examples the cyclone wall 148 can be distinct from the side walls 130.

The cyclone 144 is positioned in the air flow passage and has a cyclone air inlet 162 in fluid communication with a cyclone air outlet 164 at one end, for example the upper end 152 of the cyclone chamber 150. The cyclone 144 also includes a cyclone dirt outlet 166 spaced from the cyclone air inlet 162. In the embodiment shown, the cyclone dirt outlet 166 is disposed beneath the open bottom end 154 of the cyclone chamber 150 and is generally opposite the cyclone air outlet 164.

In use, dirty air (i.e. air containing entrained dirt particles and other debris) enters the cyclone chamber 150 via the cyclone air inlet 162. Once in the cyclone chamber 150 the air circulates in a cyclonic manner which causes dirt particles and debris in the air to contact the cyclone chamber wall 148, separating the dirt and debris from the air flow. The relatively clean air is drawn from the cyclone chamber 150, upwards through the cyclone air outlet 164 while the dirt and debris falls downward under the force of gravity and exits the cyclone dirt outlet 166.

The filtration member housing 120 also includes a dirt collection chamber 160 that is in fluid communication with the cyclone dirt outlet 166, for receiving and storing the dirt and debris separated from the air flow using the cyclone 144. The dirt chamber 160 includes an openable wall 170 that is pivotally connected to the filtration member housing 120 by a hinged joint 172. In some examples, the openable wall 170 of the dirt collection chamber 160 also forms the bottom wall 134 of the filtration member housing 120. In other examples, a separate, movable bottom wall 134 can be included beneath the openable wall 170. In the embodiment shown, the openable wall 170 is generally centrally positioned about the longitudinal axis 218 and defines a center (for example the geometric center) that separates a hinge side 174 from an opposing latchable side 176. Opening the openable wall 170 enables a user to empty the accumulated dirt and debris from the dirt collection chamber 160.

Figure 3:
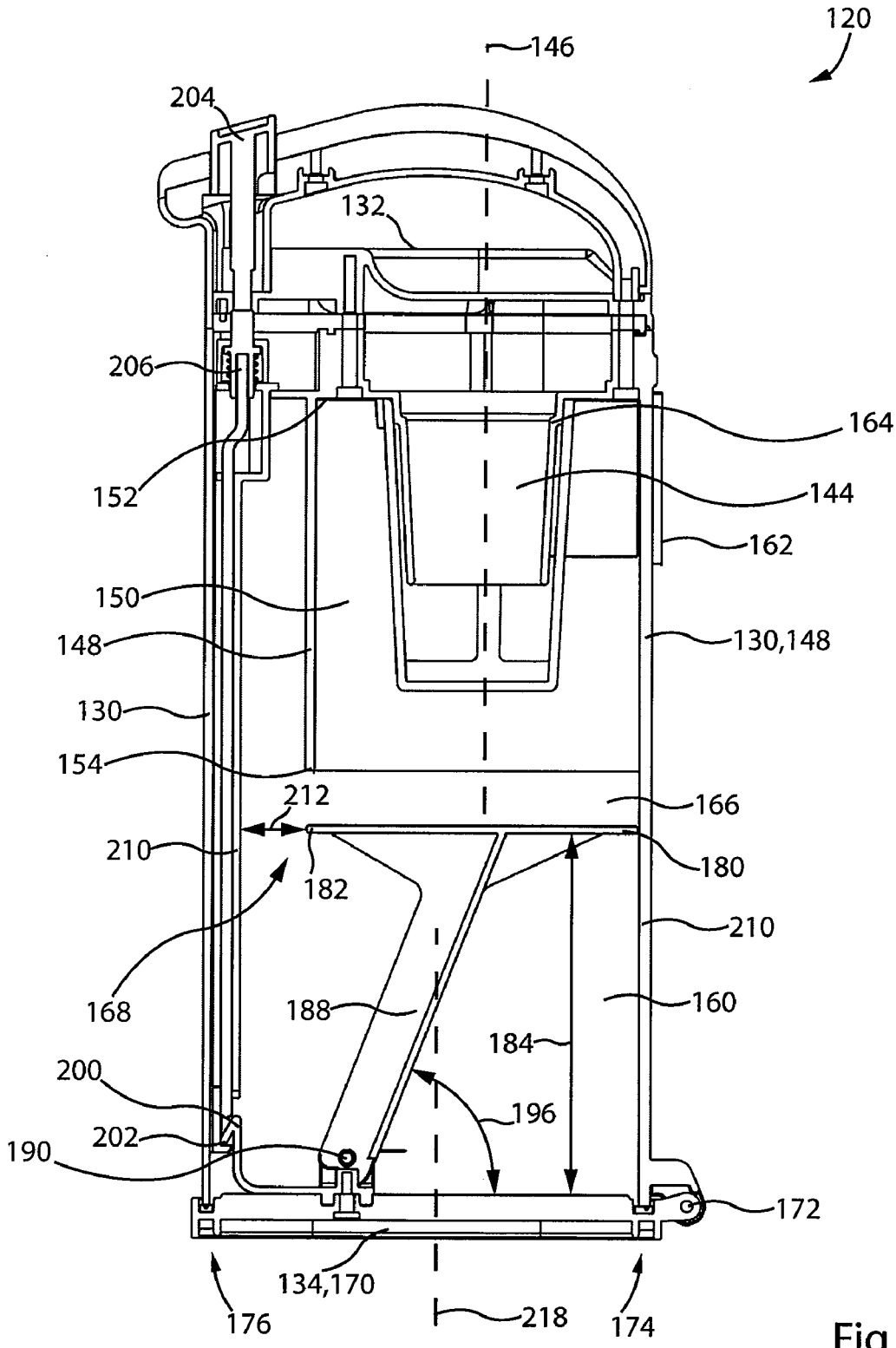
FIG. 3 is a section view of a filtration member housing of the surface cleaning apparatus of FIG. 1, taken along line 3-3.

The openable wall 170 can be held in its closed position by any suitable means including a friction fit, clips, clamps or one or more latches. As exemplified in FIGS. 3-8, one example of a suitable latch includes internal latch member 200, mounted to openable wall 170, that is configured to engage shoulder 202. Latch member 200 can be resiliently biased toward the engaged position, as exemplified in FIG. 3, and when engaged with complimentary should 202, can retain the openable wall 170 in its closed position. When a user wishes open the openable wall 170, a user can depress actuator 204 thereby causing linkage member 206 to translate downward (as shown in FIG. 3), causing a corresponding horizontal deflection (as seen in FIG. 3) of latch member 200, thereby disengaging latch member 200 from shoulder 202. Due to the resilient nature of latch member 200, it will automatically re-engage shoulder 202 when the openable wall 170 is returned to the closed position. In this example the latch member 200 also serves as a plate mount, as described in more detail.

A deflector or arrester plate is positioned at the interface between the dirt collection chamber 160 and the cyclone 144, for example deflector plate 180 positioned beneath cyclone chamber 150, defining a gap that forms cyclone dirt outlet 166. The deflector plate 180 serves to deflect and re-direct dirt and debris exiting the cyclone chamber 150 toward the dirt collection chamber 160. In the present embodiment, a dirt inlet 168 for the dirt collection chamber 160, through which dirt and debris can enter the dirt collection chamber 160, comprises the generally annular space or gap between the peripheral edge 182 of the deflector plate 180 and the inner surface of the side wall 130. In other examples, the dirt inlet for the dirt collection chamber 160 may be any other suitable configuration.

The deflector plate 180 is mounted to, and supported apart from the openable wall 170 by a support member, for example a strut 188. The strut 188 may be any type of suitable structural member that is capable of supporting the deflector plate 180 and resisting any stresses exerted on the deflector plate 180 by the air flow or dirt particles passing exiting the cyclone 144. The strut 188 can be connected to the openable wall 170 using any suitable plate mount member, for example pin joint 190. In this example the pin joint 190 also comprises the latch member 200.

In this configuration, the deflector plate 180 also forms the upper wall of the dirt chamber 160. The capacity of the dirt collection chamber 160 (i.e. the volume of dirt that can be stored in the chamber while the surface cleaning apparatus 100 is in use) can be based on the vertical distance 184 between the deflector plate 180 and the openable bottom wall 170. The dirt collection chamber 160 also has at least one longitudinally (vertically as shown) extending wall 210. In some instances the longitudinally extending wall 210 can form a portion of the side walls 130. The deflector plate has a perimeter that is spaced from at least a portion of the longitudinally extending wall 210 of the dirt collection chamber 160 by a distance 212, and the distance 212 varies along the perimeter of the deflector plate 180.

In addition to determining the dirt chamber 160 capacity, the position, size and shape of the deflector plate 180 relative to the cyclone chamber 150 can affect the performance and characteristics of the cyclone 144 in use. In the present embodiment, the deflector plate 180 is substantially the same size and shape as the bottom end 154 of the cyclone chamber 150, and is positioned to overlie substantially all of the cyclone dirt outlet 166. In this configuration substantially all of the dirt exiting the cyclone chamber can contact the deflector plate 180 and be directed to dirt inlet 168.

One method of increasing the capacity of the dirt chamber 160 (thereby increasing the vacuum time between stops to empty the chamber) is to increase the distance 184 between the deflector plate 180 and the openable wall 170, for example by lengthening strut 188. However, in existing examples where the deflector plate was fixedly connected to the openable wall, capacity of the dirt chamber could be limited because increasing the length of strut 188 would result in jamming or interference between the deflector plate 180 and the side walls 130 of the filtration member housing 120 when the openable wall 170 is opened.

Figure 4:
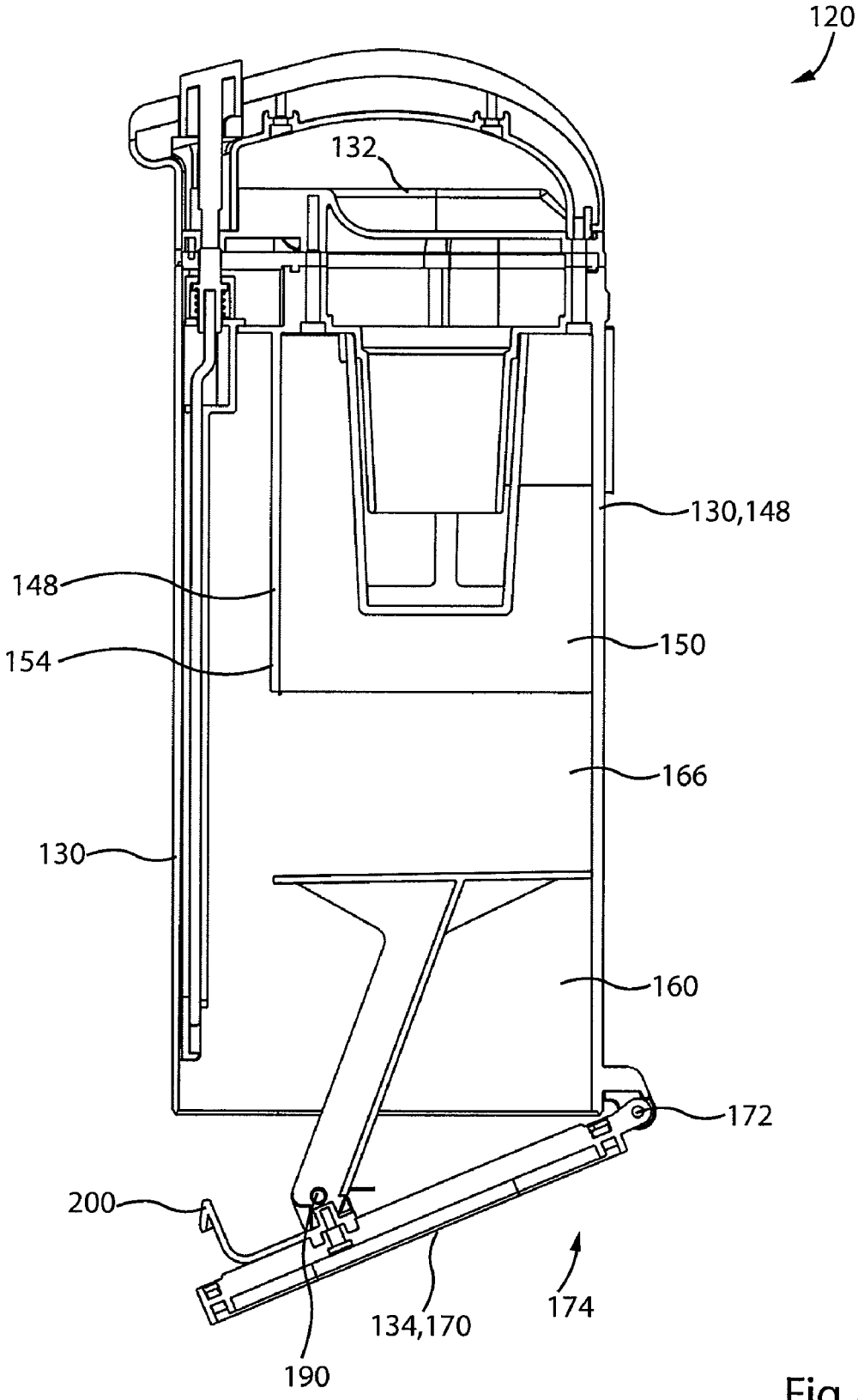
FIG. 4 is the section view of FIG. 3 showing an openable wall in a partially opened position.
Figure 5:
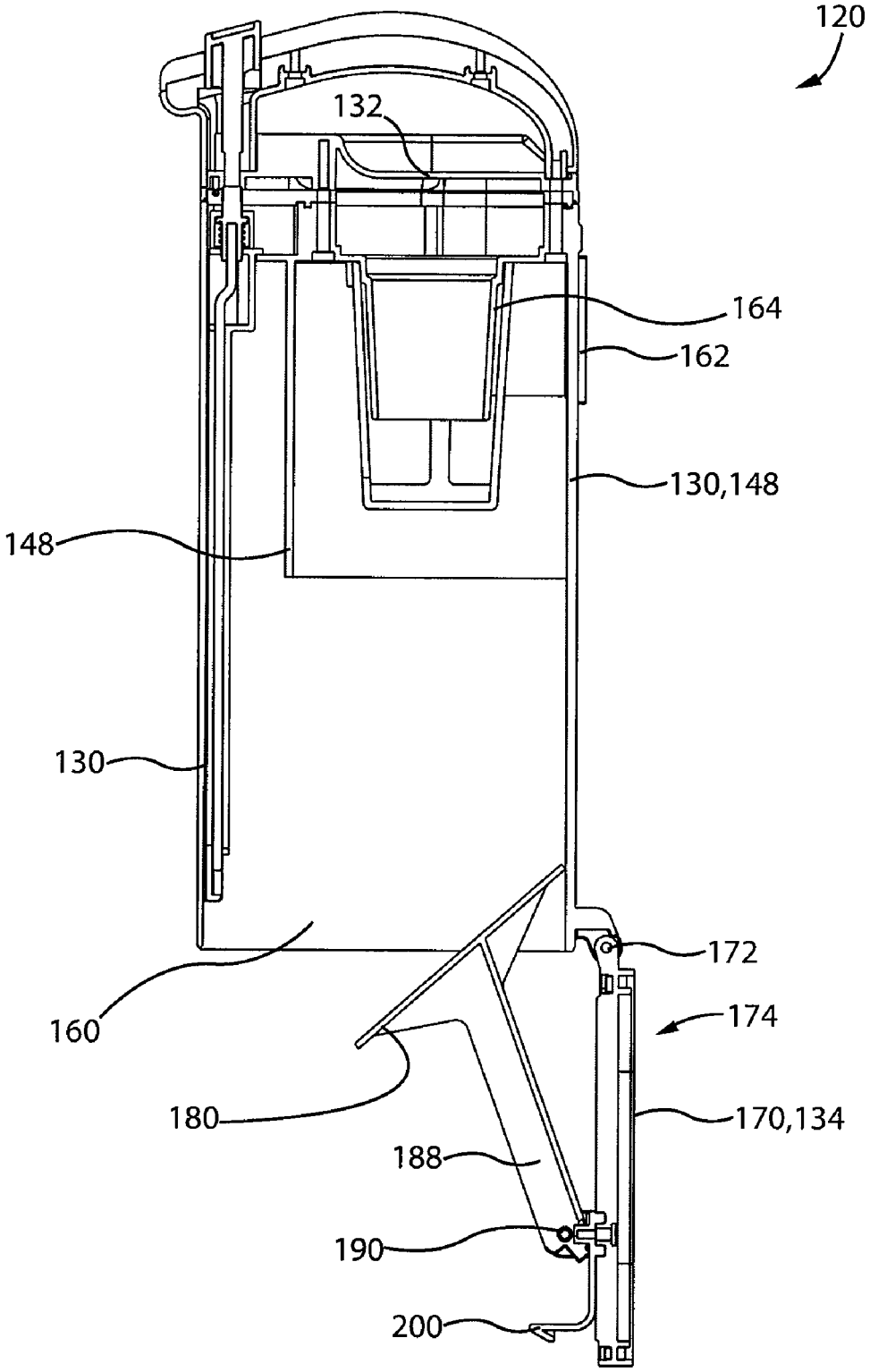
FIG. 5 is the section view of FIG. 3 showing an openable wall in a fully opened position.
Figure 6:
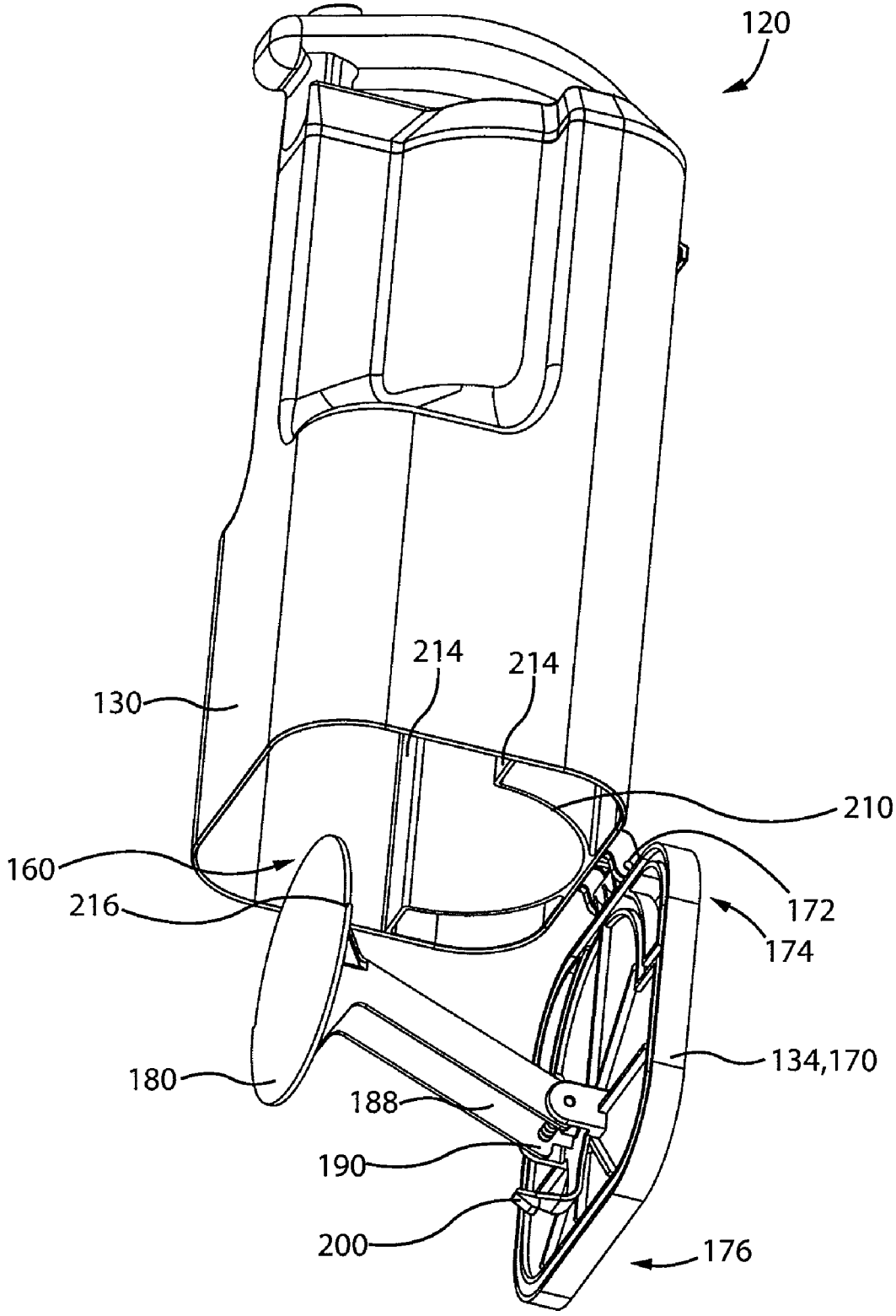
FIG. 6 is the isometric view of FIG. 2 showing an openable wall in another example of an open position.

In the present example, the strut 188 is fixedly connected to the deflector plate 180 and is movably coupled to the openable plate 170 by a pin joint 190 (or any other suitable pivotal coupling), which enables the deflector plate 180 to pivot relative to the openable plate 170, as exemplified in FIGS. 4 and 5. The pivotal connection between the strut 188 and the openable wall 170 allows the deflector plate 180 to be spaced further apart from the openable wall 170, which can increase dirt chamber capacity, and enables the deflector plate 180 to be properly positioned relative to the cyclone chamber 150, while still allowing the openable wall 170 to be opened without causing jamming between the deflector plate 180 and the side walls 130.

Figure 8:
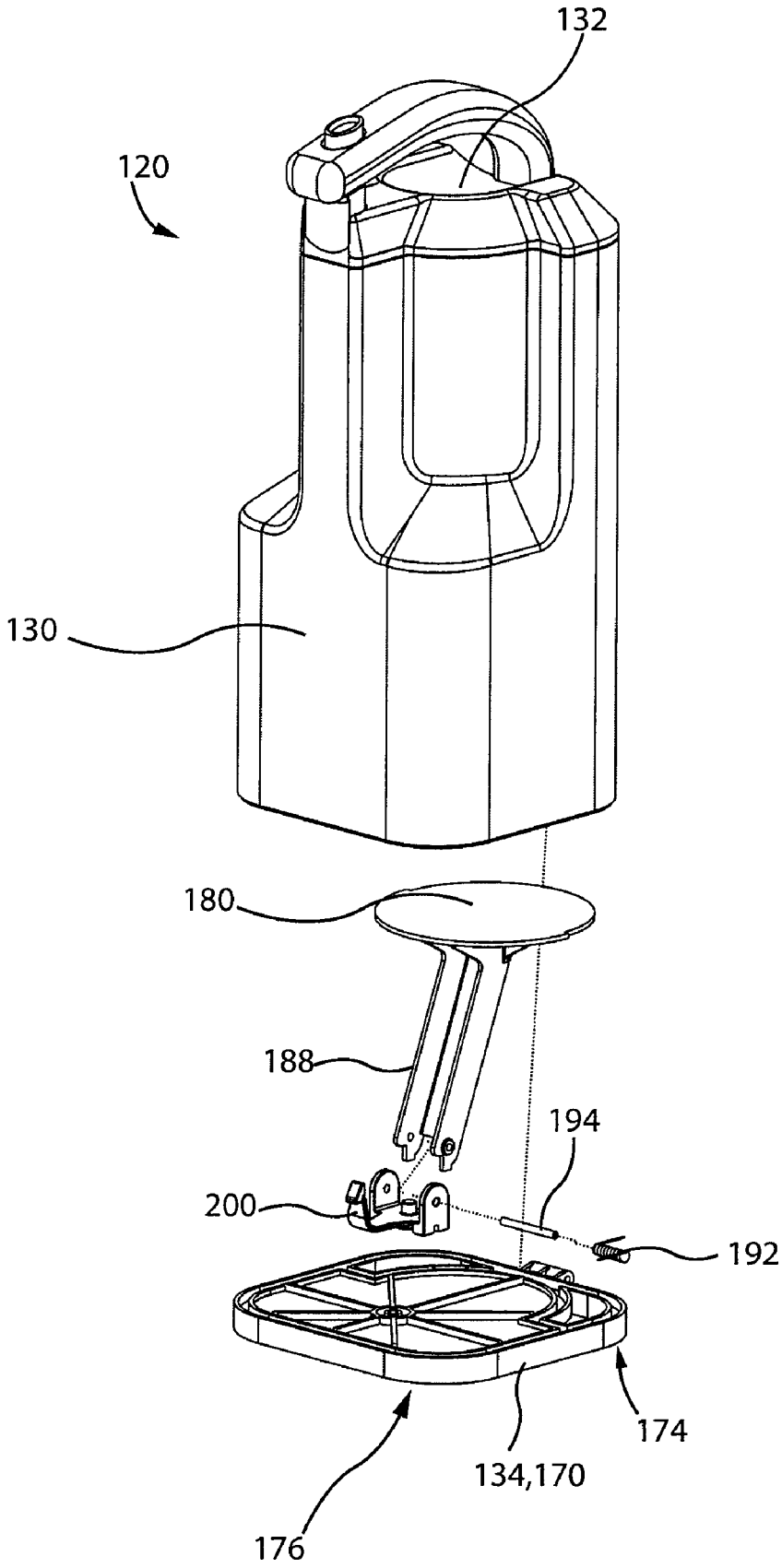
FIG. 8 is a partially exploded view of the filtration member housing of FIG. 2.

In the present example, the deflector plate 180 is configured to substantially overlie the cyclone dirt outlet 166, as described above. To keep the deflector plate 180 in the desired position, in alignment with the cyclone chamber 150, the pivot joint 190 between the strut 188 and openable wall 170 is biased using a biasing member, for example a torsion spring 192 surrounding a pin 194 (FIG. 8). The torsion spring 192 is configured to continuously bias the deflector plate 180 towards the hinge side 174 of the openable wall 170, as illustrated in FIGS. 3, 4 and 5, so that the deflector plate 180 contacts an abutment member or abutment surface within the filtration member housing 120.

In the embodiment shown, an abutment member, for example ribs 214 are provided in the dirt collection chamber 160 on the hinge side 174 for contacting the deflector plate 180. In this example, the ribs 214 form part of the longitudinally extending wall 210 and are positioned to interact with at complimentary abutment notches 216 formed on the perimeter of the deflector plate 180. In other examples, the abutment member can be another rib or different feature on the dirt chamber wall 210, a member that does not form part of wall 210 or an external element or stopper inserted into the dirt chamber 160. Optionally, the abutment member can be configured to contact the deflector plate, the support strut 188 or both to counter the force exerted by the biasing member as the openable wall 170 is moved, for example opened or closed.

Figure 7:
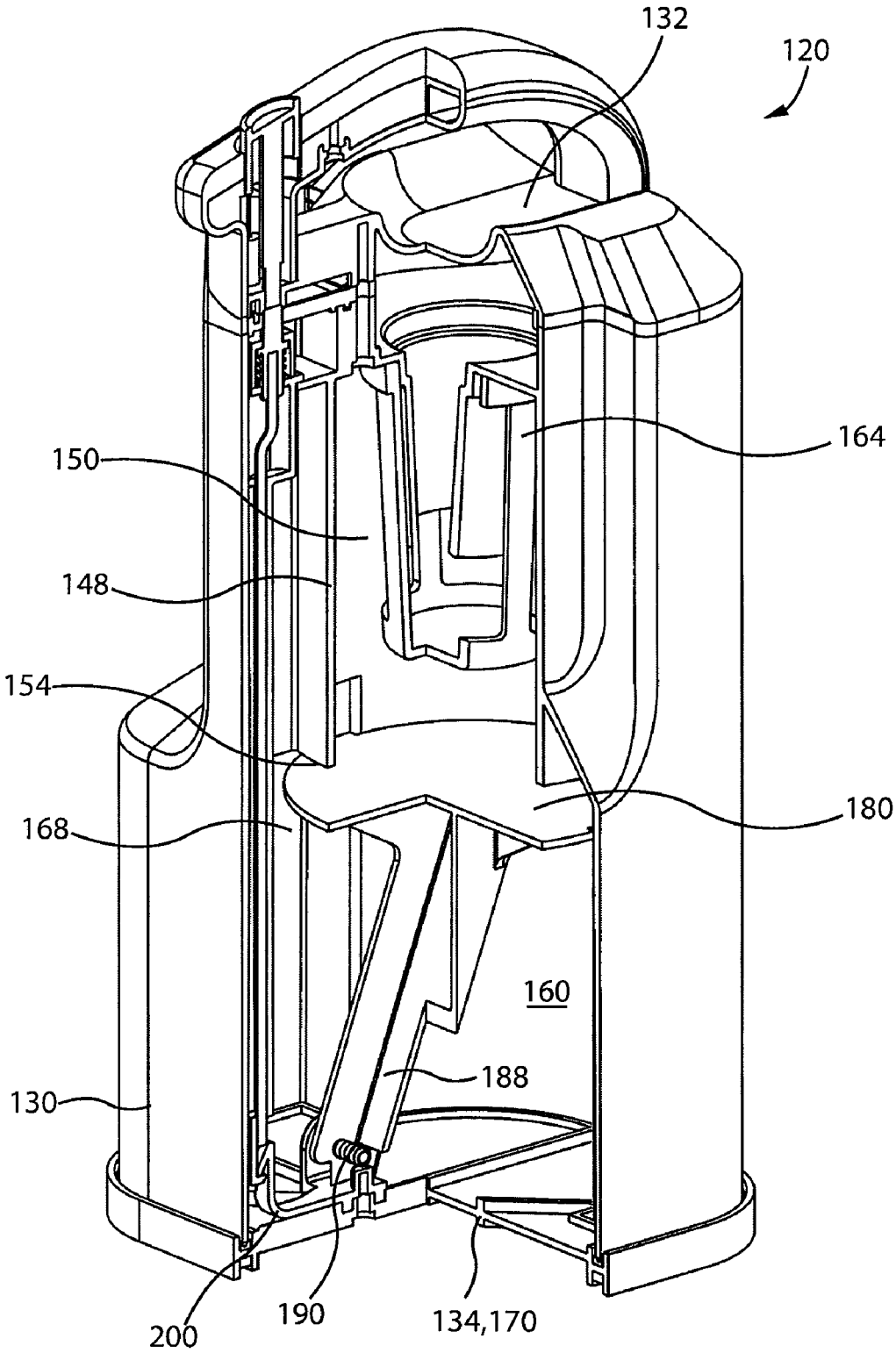
FIG. 7 is a partial section view of the filtration member housing of FIG. 2 with an openable wall in a closed position.

When the openable wall 170 is in its closed position, as exemplified in FIGS. 3 and 7, the biasing force of the torsion spring 192 forces the deflector plate 180 into its desired position, or present position, beneath the cyclone dirt outlet 166, contacting the side wall 130. As the openable wall 170 moves into an intermediary position, as exemplified in FIGS. 2 and 4, the biasing force of the torsion spring 192 keeps the deflector plate 180 disposed toward the hinge side 174 of the openable wall 170, contacting an abutment member, i.e. side wall 130, within the dirt collection chamber 160.

As exemplified in FIGS. 2-8, in a preferred example the deflector plate 180 is mounted to the openable wall 170 at a position off center from the centrally positioned longitudinal axis 146 of the cyclone 144. Referring to FIG. 3, the pin joint connection 190 between the strut 188 and the openable wall 170 is offset from the axes 146, 218 and is disposed on the latchable side 176 of the openable wall 170, away from the hinge side 174 and hinge 172.

In examples where the pin joint 190 is off-center, away from the hinge side 174, the strut 188, or any other suitable support member used to connect the deflector plate 180 to the openable wall 170, extends at an angle 196 to the longitudinal axis 146 of the cyclone when the openable wall 170 is in its closed position, as exemplified in FIG. 3. The angle 196 can be any suitable angle that enables the deflector plate 180 to be disposed in its in use position beneath the cyclone 144 when the openable wall 170 is closed, and enables the openable wall 170 to be opened without being jammed the deflector plate 180. The suitable angle 196 may be selected based on a number of factors including, for example, the configuration of the deflector plate 180, the cyclone chamber 150, the dirt collection chamber 160, the side walls 130 and any combination thereof. In some examples, angle 196 can be between 15 and 90 degrees. In other examples the angle 196 can be between 60 and 80 degrees.

As exemplified in FIG. 3, the dirt collection chamber has a dirt chamber axis 218 that extends through the center of the openable wall 170. Optionally, as exemplified, the dirt chamber axis 218 is spaced apart from the longitudinal axis 146 of the cyclone chamber 150.

Figure 2:
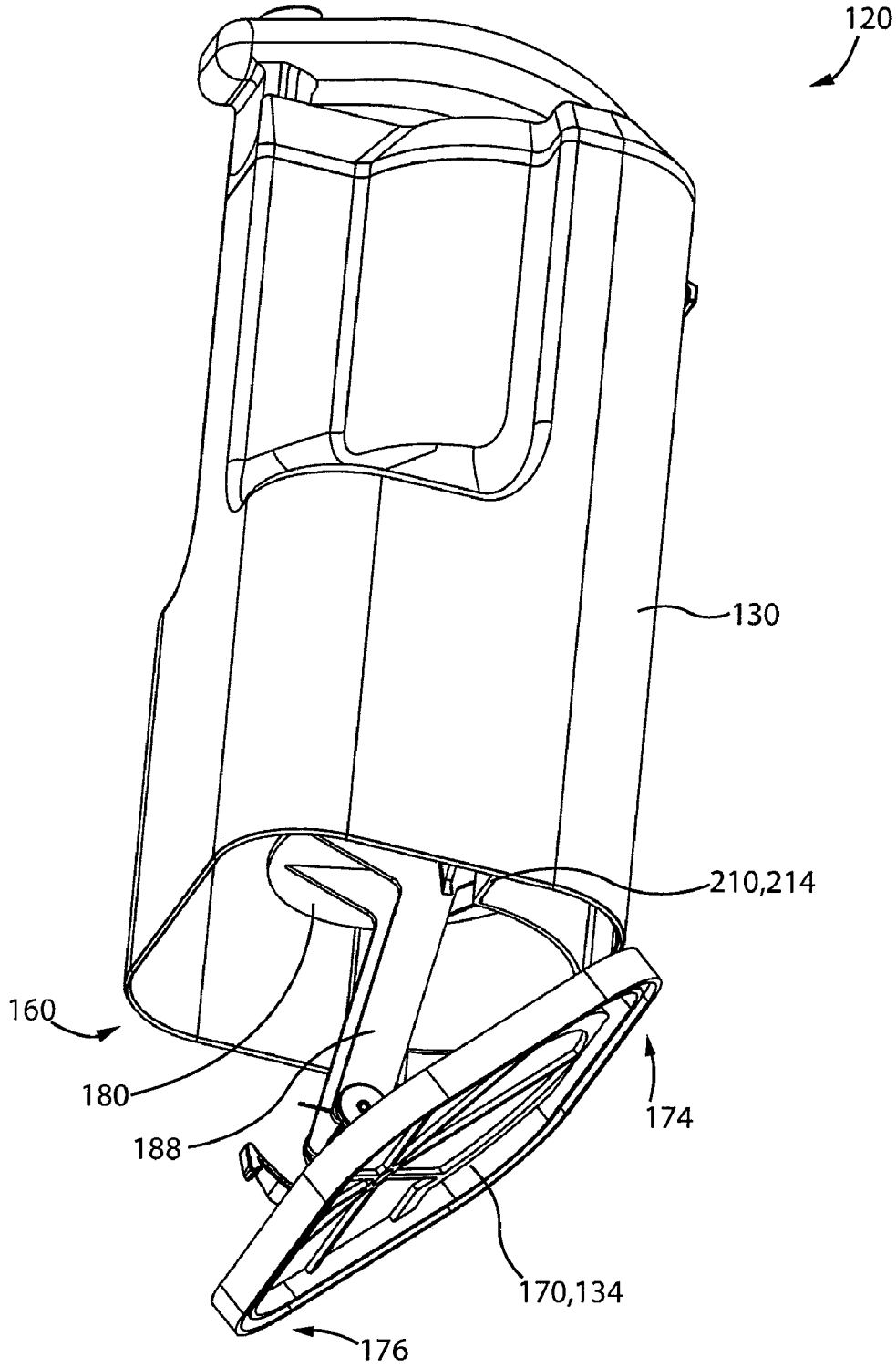
FIG. 2 is an isometric view of a filtration member housing of the surface cleaning apparatus of FIG. 1.

Generally, the dirt collection chamber 160 can be emptied by opening the openable wall 170 to an intermediate position, as exemplified in FIG. 2, 4 or 5, in which the interior of the dirt collection chamber 160 is exposed but the deflector plate 180 remains at least partially within the dirt collection chamber 160. In such a position, the deflector plate 180 is held in contact with the abutment members inside the dirt collection chamber 160 by the biasing force exerted by the torsion spring 192. In some instances, a user may wish to remove the deflector plate 180 from the dirt collection chamber 160 entirely, for example to access or service the cyclone chamber 150. In these examples, the openable plate 170 can be moved to a fully open position, as exemplified in FIG. 6, in which the deflector plate 180 can be completely removed from the dirt collection chamber 160.

Various apparatuses or methods are described above to provide an example of each claimed invention. No example described above limits any claimed invention and any claimed invention may cover processes or apparatuses that are not described above. The claimed inventions are not limited to apparatuses or processes having all of the features of any one apparatus or process described above or to features common to multiple or all of the apparatuses described above.

The invention claimed is:

1. An upright surface cleaning apparatus having a front end, a rear end and opposed lateral sides and comprising:

(a) a surface cleaning head having a dirt inlet and rear wheels, the rear wheels having an axis of rotation and a radius;

(b) an upper section moveably mounted to the surface cleaning head between a storage position in which the upper section extends upwardly from the surface cleaning head and an inclined floor cleaning position at an upper section axis of rotation that is located forward of the axis of rotation of the rear wheels and within the radius of the rear wheels, the upper section having a lower portion extending upwardly at an inclined angle from the surface cleaning head and an upper portion extending generally upwardly from the lower portion whereby the upper portion is positioned rearward of the upper section axis of rotation, the upper section comprising a removable cleaning unit and the treatment member and the suction motor are provided in the removable cleaning unit; and, (c) an air flow path extending from the dirt inlet to a clean air outlet with a suction motor and a treatment member provided in the air flow path.

2. The upright surface cleaning apparatus of claim 1 wherein the rear wheels are positioned below the upper section when the upper section is in the storage position.

3. The upright surface cleaning apparatus of claim 1 wherein the upper section is pivotally mounted to the surface cleaning head at a position that is 1-2 inches forward of the axis of rotation of the rear wheels.

4. The upright surface cleaning apparatus of claim 1 wherein the rear wheels have a diameter of 1.5-4 inches.

5. The upright surface cleaning apparatus of claim 1 wherein the rear wheels have a diameter of 2-3 inches.

6. The surface cleaning apparatus of claim 1 wherein the upper section comprises an upflow conduit on which the treatment member is provided.

7. The surface cleaning apparatus of claim 1 wherein the upper section comprises an upflow conduit on which the treatment member is provided.

8. The surface cleaning apparatus of claim 1 wherein the surface cleaning head further comprises a brush motor, an electrical conductive member electrically connects the brush motor to the upper section and the electrical conductive member comprises a wire extending from upper section to the floor cleaning head wherein at least a portion of the wire is positioned external to the upper section and the floor cleaning head.

9. The surface cleaning apparatus of claim 1 wherein the upper section axis of rotation is positioned above the axis of rotation of the rear wheels.

10. An upright surface cleaning apparatus having a front end, a rear end and opposed lateral sides and comprising:

(a) a surface cleaning head having a dirt inlet and rear wheels, the rear wheels having an axis of rotation and a radius;

(b) an upper section moveably mounted to the surface cleaning head between a storage position in which the upper section extends upwardly from the surface cleaning head and an inclined floor cleaning position at an upper section axis of rotation forward of the axis of rotation of the rear wheels and within the radius of the rear wheels, the upper section having a lower portion extending upwardly at an inclined angle from the surface cleaning head and an upper portion extending generally upwardly from the lower portion whereby the upper portion is positioned rearward of the upper section axis of rotation, the lower portion comprises an upper section mount and the upper section mount comprises a fork section wherein each fork is pivotally mounted to the surface cleaning head at laterally spaced apart locations; and, (c) an air flow path extending from the dirt inlet to a clean air outlet with a suction motor and a treatment member provided in the air flow path.

11. The surface cleaning apparatus of claim 10 wherein the upper section comprises a removable cleaning unit and the treatment member and the suction motor are provided in the removable cleaning unit.

12. An upright surface cleaning apparatus having a front end, a rear end and opposed lateral sides and comprising:

(a) a surface cleaning head having a dirt inlet and rear wheels, the rear wheels having an axis of rotation and a radius;

(b) an upper section and an upper section mount, the upper section mount moveably mounting the upper section to the surface cleaning head at a position forward of the axis of rotation of the rear wheels and within the radius of the rear wheels, the upper section being moveable between a floor cleaning position and a storage position, the upper section comprising a removable cleaning unit and the treatment member and the suction motor are provided in the removable cleaning unit; and, (c) an airflow path extending from the dirt inlet to a clean air outlet with a suction motor and a treatment member provided in the airflow path.

13. The upright surface cleaning apparatus of claim 12 wherein the rear wheels are positioned below the upper section when the upper section is in the storage position.

14. The upright surface cleaning apparatus of claim 12 wherein the upper section is pivotally mounted to the surface cleaning head at a position that is 1-2 inches forward of the axis of rotation of the rear wheels.

15. The upright surface cleaning apparatus of claim 12 wherein the upper section is pivotally mounted to the surface cleaning head.

16. The upright surface cleaning apparatus of claim 15 wherein the rear wheels have a diameter of 1.5-4 inches.

17. The upright surface cleaning apparatus of claim 16 wherein the rear wheels have a diameter of 2-3 inches.

18. The surface cleaning apparatus of claim 12 wherein the upper section comprises an upflow conduit on which the treatment member is provided.

19. The surface cleaning apparatus of claim 12 wherein the upper section comprises an upflow conduit on which the treatment member is provided.

20. The surface cleaning apparatus of claim 12 wherein the surface cleaning head further comprises a brush motor, an electrical conductive member electrically connects the brush motor to the upper section and the electrical conductive member comprises a wire extending from upper section to the floor cleaning head wherein at least a portion of the wire is positioned external to the upper section and the floor cleaning head.

21. The surface cleaning apparatus of claim 12 wherein the upper section mount extends upwardly at an inclined angle from the surface cleaning head.

22. The surface cleaning apparatus of claim 12 wherein the position at which the upper section mount is moveably mounted to the surface cleaning head is above the axis of rotation of the rear wheels.

23. An upright surface cleaning apparatus having a front end, a rear end and opposed lateral sides and comprising:

(a) a surface cleaning head having a dirt inlet and rear wheels, the rear wheels having an axis of rotation and a radius;

(b) an upper section and an upper section mount, the upper section mount moveably mounting the upper section to the surface cleaning head at a position forward of the axis of rotation of the rear wheels and within the radius of the rear wheels, the upper section being moveable between a floor cleaning position and a storage position, the upper section mount comprises a fork section wherein each fork is pivotally mounted to the surface cleaning head at laterally spaced apart locations; and, (c) an airflow path extending from the dirt inlet to a clean air outlet with a suction motor and a treatment member provided in the airflow path.

24. An upright surface cleaning apparatus having a front end, a rear end and opposed lateral sides and comprising:

(a) a surface cleaning head having a dirt inlet and rear wheels, the rear wheels having an axis of rotation and a radius;

(b) an air flow path extending from the dirt inlet to a clean air outlet with a suction motor and a treatment member provided in the air flow path; and, (c) an upper section moveably mounted to the surface cleaning head between a storage position in which the upper section extends upwardly from the surface cleaning head and an inclined floor cleaning position at an upper section axis of rotation forward of the axis of rotation of the rear wheels and within the radius of the rear wheels, the upper section comprising an upflow conduit on which the treatment member is provided, the upflow conduit is positioned rearward of the axis of rotation of the rear wheels and the upper section comprises a cleaning unit removably mounted to the upflow duct and the treatment member and the suction motor are provided in the cleaning unit.

25. The surface cleaning apparatus of claim 24 wherein the upper section has a lower portion extending upwardly at an inclined angle from the surface cleaning head and an upper portion extending generally upwardly from the lower portion whereby the upper portion is positioned rearward of the upper section axis of rotation.

26. An upright surface cleaning apparatus having a front end, a rear end and opposed lateral sides and comprising:

(a) a surface cleaning head having a dirt inlet and rear wheels, the rear wheels having an axis of rotation and a radius;

(b) an airflow path extending from the dirt inlet to a clean air outlet with a suction motor and a treatment member provided in the airflow path; and, (c) an upper section and an upper section mount, the upper section mount moveably mounting the upper section to the surface cleaning head at a position forward of the axis of rotation of the rear wheels and within the radius of the rear wheels, the upper section being moveable between a floor cleaning position and a storage position, the upper section comprises an upflow conduit on which the treatment member is provided, the upflow conduit is positioned rearward of the axis of rotation of the rear wheels and the upper section comprises a cleaning unit removably mounted to the upflow duct and the treatment member and the suction motor are provided in the cleaning unit.

* * * * *